US008246401B2

(12) United States Patent
Kluge

(10) Patent No.: US 8,246,401 B2
(45) Date of Patent: Aug. 21, 2012

(54) KORT NOZZLE

(75) Inventor: Mathias Kluge, Hamburg (DE)

(73) Assignee: becker marine systems GmbH & Co., KG, Hamburg (DE)

( * ) Notice: Subject to any disclaimer, the term of this patent is extended or adjusted under 35 U.S.C. 154(b) by 117 days.

(21) Appl. No.: 12/838,994

(22) Filed: Jul. 19, 2010

(65) Prior Publication Data

US 2010/0323566 A1 Dec. 23, 2010

Related U.S. Application Data

(63) Continuation of application No. 12/069,171, filed on Feb. 7, 2008, now abandoned.

(30) Foreign Application Priority Data

Nov. 16, 2007 (DE) ..... 20 2007 016 163 U

(51) Int. Cl.
*B63H 5/15* (2006.01)

(52) U.S. Cl. ..... 440/67

(58) Field of Classification Search ..... 114/166; 440/48, 49, 66, 67
See application file for complete search history.

(56) References Cited

U.S. PATENT DOCUMENTS

| | | | |
|---|---|---|---|
| 442,615 | A | 12/1890 | Dock |
| 2,139,594 | A | 12/1938 | Kort |
| 3,508,517 | A | 4/1970 | Hannan |
| 3,738,307 | A | 6/1973 | Jaconsen et al. |
| 3,899,992 | A | 8/1975 | Fuller |
| 4,637,801 | A | 1/1987 | Schultz |
| 6,159,062 | A | 12/2000 | Taylor, Jr. |

FOREIGN PATENT DOCUMENTS

| | | |
|---|---|---|
| DE | 58558 | 12/1890 |
| DE | 2129067 | 12/1971 |
| GB | 1215136 | 12/1970 |
| WO | 8502594 | 6/1985 |

*Primary Examiner* — Edwin Swinehart
(74) *Attorney, Agent, or Firm* — Kelly & Kelley, LLP

(57) ABSTRACT

In order to indicate a Kort nozzle configured rotatable around the rudder axis of a ship, for which the occurrence of recirculations or of swirls is avoided or reduced even with an angular position with respect to a longitudinal axis of the ship and a globally uniform flow pattern adjusts as far as possible, at least one opening is provided in each of two central areas of a nozzle ring enveloping a ship's propeller.

23 Claims, 7 Drawing Sheets

PRIOR ART

KORT NOZZLE

FIELD OF THE INVENTION

This invention relates to a Kort nozzle which is configured rotatable about the rudder axis of a ship.

BACKGROUND OF THE INVENTION

A Kort nozzle is a conically tapered tube or duct in which the propeller of a ship is placed. The tube is a so-called nozzle ring and forms the wall of the Kort nozzle. Due to the taper of the nozzle ring towards the stern of the ship, the Kort nozzles can transmit an additional thrust to the ship without the output having to be increased. Besides the propulsion improving properties of the Kort nozzle, pitching by rough sea is thus reduced so that by sea disturbance the lost of velocity can be reduced and the directional stability can be increased. Since the inherent resistance of the Kort nozzle increases approximately quadratically as the speed of the ship increases, its advantages are effective in particular for slow ships which have a big propeller thrust (for example tugboats, fishing vehicles, etc.).

Besides fixed Kort nozzles behind which normally a rudder is placed in flow direction for the control of the ship, there are so-called "Kort rudder nozzles" for which the Kort nozzle is rotatable about the rudder axis of the ship which is in vertical direction. For this purpose, bearings are normally provided on the upper and lower side of the Kort nozzle on the outside of its wall (nozzle ring) for the rotatable positioning. In contrast, the propeller is still fixed so that the Kort nozzle also rotates around the propeller. Frequently, the Kort nozzle is connected with the rudder post and positioned in the rudder heel. It is normally swivelable about a vertical axis of rotation or about the rudder axis by approximately 30° to 35° to both sides, the starboard side and the port side. Thus, the Kort nozzle is a combination of propulsion improving means and rudder since a rudder effect is achieved by the excursion of the propeller jet at an angle to the ship longitudinal axis. For excursed rudder nozzles, the stern of the ship is pushed by the jet reaction propulsion.

FIG. 5 illustrates an embodiment of a Kort nozzle 200 positioned rotatable about the rudder axis of a ship with a fixed propeller placed therein as it is known from the prior art. The Kort nozzle 200 is placed around the fixed ship propeller 210 of a ship (not represented here). Here the Kort nozzle is pivoted under an angle $\alpha$ of approximately 30° about the ship longitudinal axis 220. The arrow 221 represents the flow direction of the sea water or salt water. A fixed flap 230 is provided in flow direction behind the propeller on the Kort nozzle 200, through which the flow properties of the Kort rudder nozzle are positively influenced. Due to a reduced wall thickness, the inlet area 201 (with respect to the direction of the flow passing through the Kort nozzle 200) is configured widened with respect to the remaining area of the Kort nozzle 200. This means that the inner diameter of the inlet area is bigger than the inner diameter in the remaining area of the Kort nozzle 200. The water flow through the Kort nozzle 200 is increased which in turn increases the propulsion efficiency of the Kort nozzle.

Comprehensive calculations, tests and simulations of the applicant resulted in that, for certain twisting angles of a conventional Kort nozzle, swirls or recirculations of the flow form in the area directly aft of the propeller. These recirculations or swirls have a disadvantageous effect on the power of the Kort nozzle. They develop in particular directly behind the propeller in the side area of the propeller to which the Kort nozzle is turned. Due to the recirculations the flow rate of the water flowing through is considerably reduced in this area so that the driving power of the Kort nozzle is reduced. Since the recirculations occur only in a locally limited side area and the flow runs substantially laminarly in the other areas as usual, considerable vibrations which can be transmitted to the hull of the ship and which have also a disadvantageous effect occur. Reference is made in this regard to the FIGS. 6*a* and 6*b* for illustrating this problem.

FIG. 6*a* shows schematically the top view of a cut Kort nozzle 200 as it is known from the state of the art. The arrows in FIGS. 6*a* and 6*b* constitute the course of the flow. The ship propeller 210 is drawn only schematically for reasons of clarity. For this Kort nozzle 200, contrary to the Kort nozzle of FIG. 5, a movable or swivelable flap 231 is placed in flow direction behind the propeller 210. The Kort nozzle 200 is swiveled with an angle of approximately 15° with respect to the ship longitudinal axis. The rear part of the wall 202*a* of the Kort nozzle 200 has been rotated against the flow direction, i.e. to the propeller 210, while the opposed part of the wall 202*b* has been rotated with the flow direction accordingly.

The lower part area of the Kort nozzle 200 which is marked in FIG. 6*a* is depicted enlarged in FIG. 6*b*. It can be recognized therein that, due to the angular position of the Kort nozzle 200 with respect to the propeller 210 or to the ship longitudinal axis 220, a swirl or recirculation of the flow forms in the outer edge area in flow direction directly behind the propeller 210. Due to this recirculation, the mean flow rate in the main flow direction 221 is reduced to a minimum in this local area. Measurements and simulations in this area showed that there is a mean flow rate of 0.2 to 2 m/s in the main flow direction 221. Compared to this, the mean flow rate is situated within a range of 12 to 16 m/s in the area between the flap 231 and the wall area 202*b*.

The water which flows laminarly outside along the wall 202*a* flows around the rounded-off edge of the wall of the Kort nozzle end area 203 to the inside and hits there the flow produced by the propeller 210 which is directed in the main flow direction 221. A part of the outer flow is directed to the inside against the main flow direction 221 and flows on the inner side of the wall 202 against the main flow direction 221 to the area behind the propeller 210 and from there back again through the propeller 210. Thus, a local circulation or recirculation of the flow is formed and the mean flow rate in the main flow direction 221 in this area is around zero. Therefore, the disadvantages described above occur.

SUMMARY OF THE INVENTION

Starting from the prior state described above, the object of this invention is to provide a Kort nozzle for which the occurrence of recirculations or swirls is avoided or reduced even with an angular position with respect to the ship longitudinal axis and which has a uniform over-all flow pattern.

In order to achieve this object, the core idea of this invention consists in that the nozzle ring, which forms the wall of the Kort nozzle, has two central areas with regard to the height of the Kort nozzle, the first central area being situated on the starboard side of the nozzle ring and the second central area being situated on the port side of the nozzle ring. In each of the central areas, at least one opening is provided in the nozzle ring, i.e. in the wall of the Kort nozzle. In this context, with openings, basically any opening or aperture of any configuration in the wall of the Kort nozzle, i.e. in the nozzle ring, is to be considered. The opening extends through the whole wall and thus consists of an inner and of an outer opening area and a central area connecting these two areas. It is decisive that a flow connection is created for the sea water or the salt water from outside the Kort nozzle through the at least one opening into the inside of the Kort nozzle.

By providing openings in the two central areas of the nozzle ring, it is thus achieved that the openings are placed in an area in which the swirls typically occur, i.e. towards the middle with regard to a vertical dimension of the Kort nozzle and towards the two side areas with regard to a horizontal dimension of the Kort nozzle. Thus, the laminar flow flowing through the at least one opening of each central area can develop an optimal effect and can suppress the swirl as much as possible. According to the invention, it is particularly preferred to provide a central arrangement of the at least one opening with respect to the height of the Kort nozzle. This being, the height of the Kort nozzle corresponds to its vertical extension when mounted, i.e. to the distance between the opposed wall areas of the Kort nozzle along its vertical axis or along the rudder axis. Based on the configuration of the invention, the openings are provided in lateral areas of the Kort nozzle, on the starboard side and on the port side (i.e. central areas of the nozzle ring). In a horizontal direction, the central areas in principle can be confined to a certain area or can extend from a forward upstream end of the nozzle ring to an aft downstream end of the nozzle ring.

The wall of the Kort nozzle is formed by the nozzle ring which envelops the stationary ship propeller. It is decisive that the openings are configured provided or placed in the wall in such a manner that through the openings sea water or salt water can flow from outside the Kort nozzle into the inside of the Kort nozzle in such a manner that the recirculations or swirls which develop at certain swiveling angles of the Kort nozzle are suppressed or considerably reduced. Tests of the applicant resulted in that, due to such openings, the thrust of the Kort nozzle has been increased in the side areas in which typically swirls or recirculations occur by up to 20%. Furthermore, the vibrations transmitted to the hull have been reduced.

Due to the openings, a laminar flow is thus introduced from outside to the critical side areas of the Kort nozzle in which the swirls typically occur at certain swiveling angles. This laminar flow avoids that a recirculation flow can be formed in the side areas against the main flow direction. The thrust and the working stability and thus the efficiency of the Kort nozzle are considerably improved herewith.

In order to ensure that the (laminar) flow in the critical side areas and/or in other areas of the Kort nozzle is not disturbed, openings are exclusively provided in the two central areas of the nozzle ring. In other words, the other areas of the nozzle ring outside the central areas consist exclusively of solid nozzle wall and have no openings. Thus, the other areas of the nozzle ring are configured to be watertight, i.e. there is no possibility for the sea water to flow from outside the Kort nozzle to inside the Kort nozzle through the nozzle ring or vice versa. In this way, it is ensured that only in the critical side areas of the Kort nozzle where recirculations or swirls occur, the water flow is redirected and that the water flow through the rest of the areas of the Kort nozzle remains undisturbed or unchanged. The openings are also entirely disposed in the central areas, i.e. they do not extend beyond the central areas. Further, in a cross-sectional view, the nozzle ring wall areas with openings is less than 50%, preferably less than 30%, very preferably less than 20%, most preferably less than 15% of the total wall area of the nozzle ring.

The nozzle ring is configured integrally formed, that means that the nozzle ring is made of one-piece and forms a monolithic wall in form of a duct or tube. In both central areas, apertures are provided in this monolithic wall.

The at least one opening of the first central area and the at least one opening of the second central area are both at all times or in all states unsealed. In other words, the openings are always open and water flows through both openings continuously throughout the operation of the Kort nozzle. There are no covers or the like that disturb the water flow through the openings. In this way it is ensured that the outside-in flow of water through the opening is provided for in all situations of operation where needed.

In a preferred embodiment of the invention, both openings, i.e. the at least one opening of the first central area and the at least one opening of the second central area, are placed substantially opposite each other. Both openings are also placed respectively in a side area (i.e. in the central areas of the nozzle ring) of the Kort nozzle since the swirls or recirculations develop there in Kort nozzles. It is thus guaranteed that the risk of the occurrence of swirls or recirculations is reduced for a swiveling to the starboard side as well as for a swiveling to the port side.

With respect to the height of the Kort nozzle, according to a preferred embodiment of the invention, the first and/or the second central area range from one-third of the height of the Kort nozzle to approximately two-thirds of the height of the Kort nozzle, preferably from two-fifths to three-fifths of the height of the Kort nozzle. It is thus ensured that the openings are provided in areas that are located in a middle area of the Kort nozzle with regard to its vertical dimension since in this middle the recirculations occur.

The central areas of the Kort nozzle may extend in their longitudinal (horizontal) extension over the whole length of the Kort nozzle. There are thus two central areas which are placed opposite to each other. According to another preferred embodiment of the invention, at least two openings are disposed in at least one of these two central areas, preferably in both central areas. Furthermore, these at least two openings are disposed in longitudinal direction of the Kort nozzle one behind the other and/or in vertical direction above one another. Depending on the configuration of the Kort nozzle and of the propeller as well as the respective swiveling angle, the result to be achieved can thus be optimized, namely the improvement of the thrust and of the quiet running of the Kort nozzle. If at least two openings are respectively provided in both central areas, the openings of both central areas are advantageously placed (exactly) opposite to each other.

With respect to the length of the Kort nozzle, i.e. the dimensions of the Kort nozzle, when the Kort nozzle is not swiveled about the ship longitudinal axis, according to another preferred embodiment, the at least one opening of the first central area and the at least one opening of the second central area are disposed in an area from one-third to two-thirds of the length (in an longitudinal direction), preferably from two-fifths to three-fifths of the length, particularly preferably in the middle. The effect of the at least one opening can again be optimized by this measure too.

It is further preferred that the at least one opening of the first central area and the at least one opening of the second central area are disposed aft of the propeller when the propeller is in its non-deflected state, i.e. the propeller is not swiveled (at 0°) and the ship is going straight ahead. In other words the openings are disposed behind the propeller in the flow direction of the water. Thus, it is ensured that the openings are located in an advantageous position for positively influencing the recirculations.

It is further preferred that the nozzle ring is configured conically tapering. Towards the back side of the nozzle ring so that the flow through the nozzle ring towards the propeller is accelerated.

For a swivelable Kort nozzle with a fixed ship propeller placed therein, it is furthermore preferred to configure the openings in such a manner that they are disposed, with their respective inner opening area substantially adjacent to the propeller at a swiveling angle of 10° to 20°, preferably 12° to 18°, very preferably 15°. It is thus guaranteed that when the nozzle ring is swiveled with the above mentioned typical swiveling angles, the laminar flow which comes out of the inner opening area of the at least one opening, flowing from the outside to the inside into the Kort nozzle, hits directly the swirl area (recirculation areas). The laminar flow can thus directly act against the recirculation flow and the effect of the at least one opening is further improved. Should in some cases other swiveling angles be employed, the arrangement of the at least one opening can naturally be adapted accordingly, for example to swiveling angles of 10° to 30° or 20° to 30°.

For the further optimization of the effect of the openings for the efficiency of the Kort nozzle, it is provided in a further preferred embodiment of the invention to configure the openings as oblong slits. Moreover, it is advantageous that the slit like openings substantially extend in the vertical direction. It is thus achieved that a vertically orientated flow band flows into the Kort nozzle from the outside to the inside and thus positively influences the critical area in which normally swirls develop. Furthermore, such openings can be produced relatively easily.

Furthermore, it is preferred that the openings extend obliquely from the outside to the inside with respect to the main flow direction through the nozzle ring. This means that the middle line of the openings is orientated with a predetermined angle to the main flow direction or to the longitudinal axis of the Kort nozzle. It is thus guaranteed that the outer laminar flow flows from the outside to the inside into the Kort nozzle and that no water flows from the inside to the outside through the at least one opening of the first central area and the at least one opening of the second central area.

It is preferred in particular to configure the at least one opening of the first central area and the at least one opening of the second central area with respect to the longitudinal axis of the Kort nozzle with an angle of 10° to 60°, preferably 20° to 45°, particularly preferably 30° to 35°. The indications of angles refer to the angle between the longitudinal axis of the Kort nozzle and the middle line of the openings which extends from the outside to the inside through the openings.

For a further preferred embodiment of the invention, it is provided that the openings taper from the outer side of the nozzle ring or from their outer opening area to their inner opening area on the inner side of the nozzle ring. The speed of the flow which flows from outside into the Kort nozzle can thus be increased so that the overall efficiency of the Kort nozzle and the risk of the occurrence of turbulences or recirculations are further reduced.

Alternatively, the at least one opening of the first central area and the at least one opening of the second central area can be configured substantially constant over their whole extension.

Appropriately, at least one of the admission edges and/or at least one of the discharge edges of the at least one opening of the first central area and the at least one opening of the second central area is to be configured rounded-off. In the flow direction, each opening has, for example for a slit like vertically orientated opening, two vertically orientated admission edges and two vertically orientated discharge edges. The admission through the opening into the Kort nozzle is thus improved in so far as the risk that unwished swirls can occur on the admission or discharge edges due to a breakaway of the flow is reduced.

BRIEF DESCRIPTION OF THE DRAWINGS

Different embodiments of the invention will be explained in more detail below with reference to the figures represented in the drawings.

DETAILED DESCRIPTION OF THE INVENTION

Figure 1A:
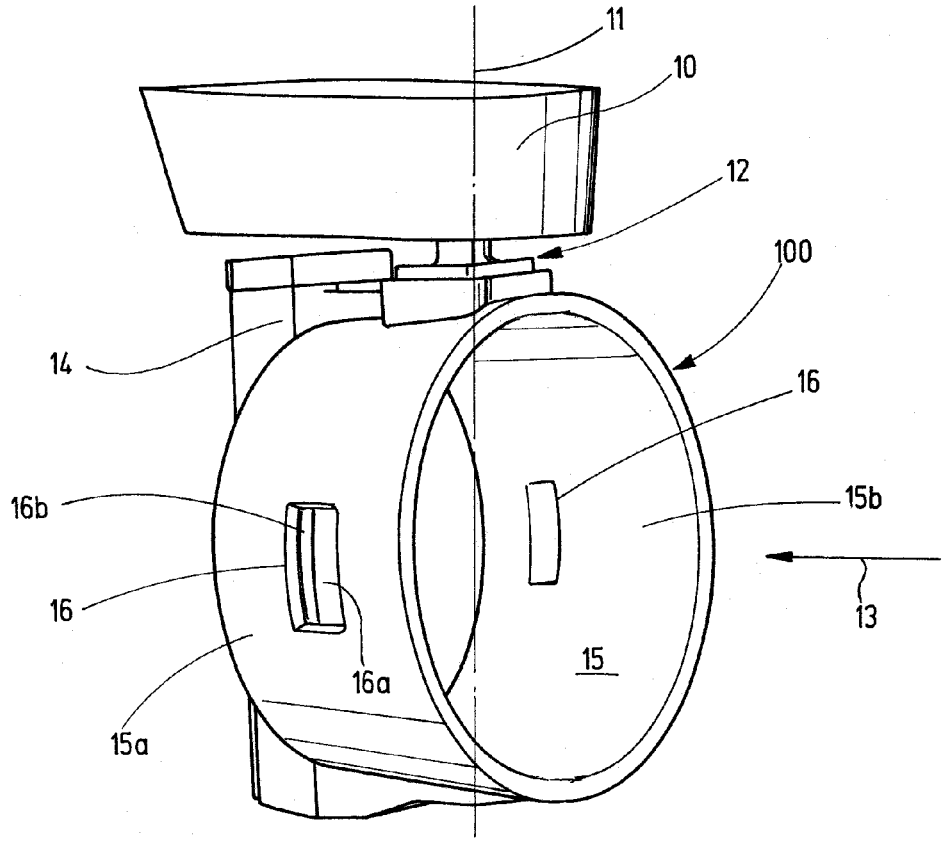
FIG. 1*a* shows schematically a perspective view of a Kort nozzle with two opposite openings which is positioned swivelable on the hull of a ship.

For the different embodiments represented below, the same components are provided with the same reference numerals.

FIG. 1*a* shows a perspective view of a Kort nozzle 100 which is positioned swivelable on the hull 10 of a ship. The hull 10 of a ship is depicted only partially for reasons of clarity. The Kort nozzle is connected with the hull 10 by means of a bearing 12 and is rotatable about the rudder axis 11. The rudder axis 11 corresponds to the vertical axis. The Kort nozzle 100 is furthermore connected with the hull in its lower area by a further bearing (not represented here). Considering the flow direction 13, a movable or controllable flap 14 follows at the end of the Kort nozzle 100. The Kort nozzle 100 comprises a ring-shaped configured nozzle ring 15 which is configured conically and which tapers in the flow direction 13 and which forms the wall of the Kort nozzle 100. An opening 16 is placed respectively in each central side areas 15*a*, 15*b* of the nozzle ring 15 with respect to the height of the Kort nozzle. The openings 16 are disposed substantially in the middle of the nozzle ring with respect to the height. The openings 16 extend obliquely from the outside to the inside, this being considered in the flow direction 13. They consist in a slit extending substantially vertically which tapers from the outside to the inside. Thus the openings 16 have an approximately shovel-type appearance since the outer opening area 16*a* is wider than the inner opening area 16*b* because of the taper of the opening 16. The propeller is omitted in FIG. 1*a* for reasons of clarity but is placed, when mounted, inside the Kort nozzle 100. It can be seen from FIG. 1*a* that the two openings 16 are the only openings provided in the nozzle ring 15 and thus, all areas of the nozzle ring 15 other than the central areas 15*a*, 15*b*, do not have openings but rather have a solid, monolithic wall without apertures. In other words, only in the central areas 15*a*, 15*b* there are provided openings 16. The nozzle ring is a single ring formed of one piece. Also the two openings 16 are configured symmetrically to each other when considering the vertical axis of rotation of the Kort nozzle to be an axis of symmetry. That means that the shape dimensions and the positions of the at least one opening of the first central area and the at least one opening of the second central area are configured equally and correspondingly.

Figure 1B:
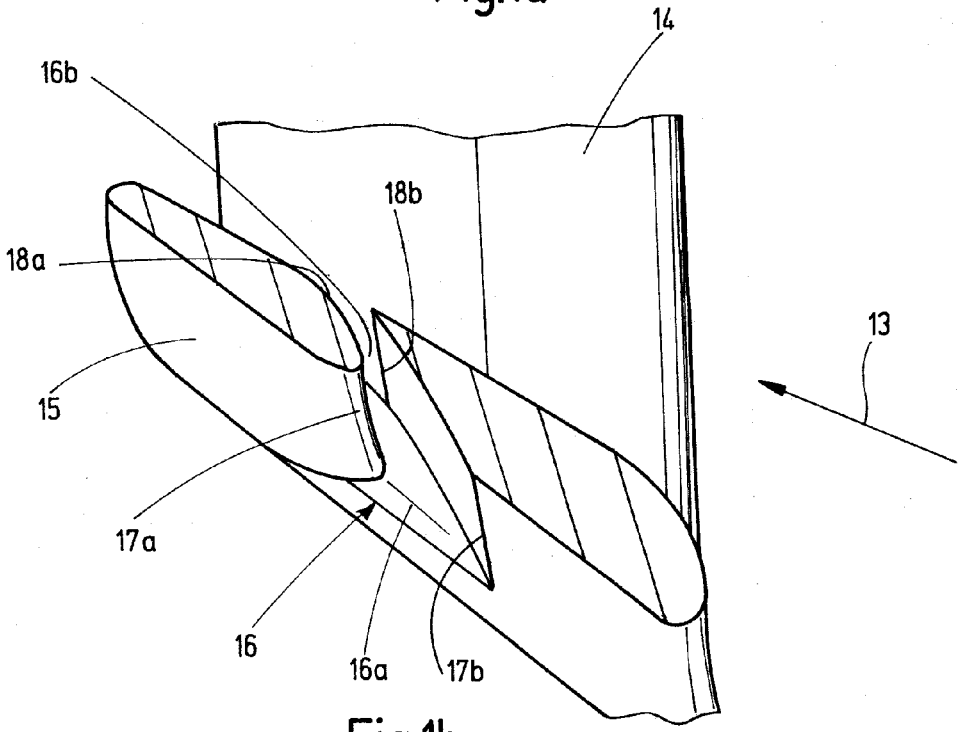
FIG. 1*b* shows schematically a sectional view of a portion of the Kort nozzle of FIG. 1*a*.

FIG. 1*b* shows a sectional view of a portion of the Kort nozzle 100 of FIG. 1*a*. In particular, the nozzle ring of the Kort nozzle 100 of FIG. 1*b* is cut in the area of an opening 16. It can be recognized that the opening 16 extends in flow direction obliquely from the outside to the inside and that it tapers to the inside. Correspondingly, the outer opening area 16*a* is wider than the inner opening area 16*b*. Among the two horizontally extending admission edges 17*a*, 17*b* of the opening 16, the rear admission edge 17*a* is configured rounded-off while the front admission edge 17*b* is configured angular. In the same way, the rear discharge edge 18*a* is rounded-off in flow direction 13 while the front discharge edge 18*b* is angular. When considered from the side, the outer opening area 16*a* and the inner opening area 16*b* of the opening are offset to each other, in particular they are placed offset laterally to each other. Thus, the inner opening area 16*b* is covered by the obliquely extending side walls of the opening 16 or by the wall of the nozzle ring 15, with respect to a side view of the Kort nozzle 100. In other words, the opening is configured as a slit like channel which extends obliquely from the outside to the inside in flow direction 13.

Figure 2A:
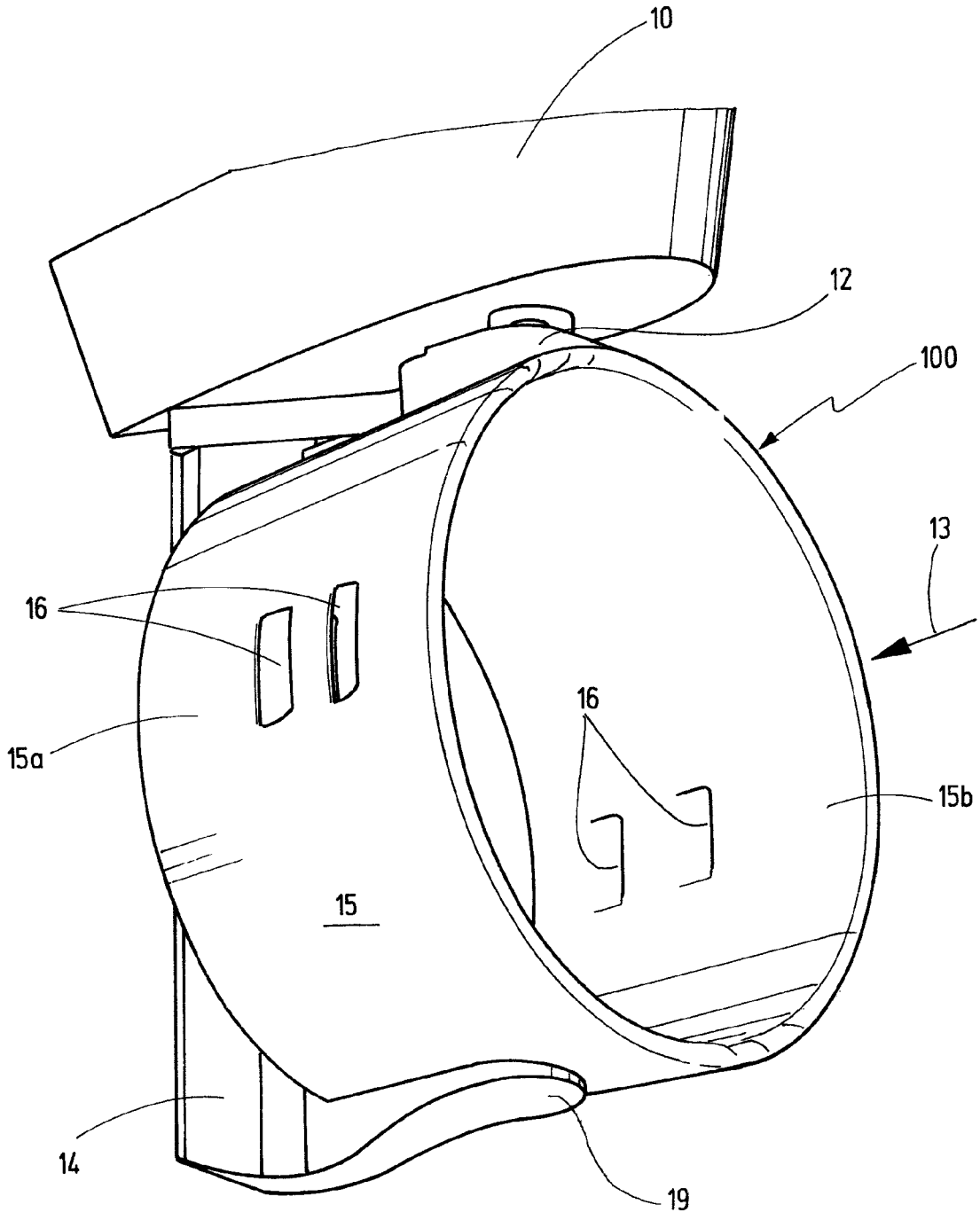
FIG. 2*a* shows schematically a perspective view of a Kort nozzle swivelably positioned on a hull of a ship for which two openings situated in succession in a horizontal direction are placed in each central area.

FIG. 2*a* shows a perspective view of a further embodiment of a Kort nozzle according to the invention 100. It can be recognized in FIG. 2*a* that the flap 14 is supported in the upper rudder bearing 12 as well as in a lower flap bearing on the Kort nozzle 100. Furthermore, two openings 16 are respectively placed in each central area 15*a*, 15*b* of the nozzle ring 15, wherein the two openings of each area 15*a*, 15*b* are situated one behind the other in a ship longitudinal direction, when the Kort nozzle is not deviated, or in the longitudinal direction of the Kort nozzle. It can be recognized in FIG. 2*a* that only the outer opening area of the openings 16 can be seen from the outside and the inner opening area is covered. Correspondingly, the outer and the inner opening area of the opening 18 are placed one behind the other in flow direction 13. In areas other than the central areas 15*a*, 15*b*, the nozzle ring does not have any additional openings. Also, the two openings of the area 15*a* are configured to be symmetrical with regard to the two openings of the central area 15*b*.

Figure 2B:
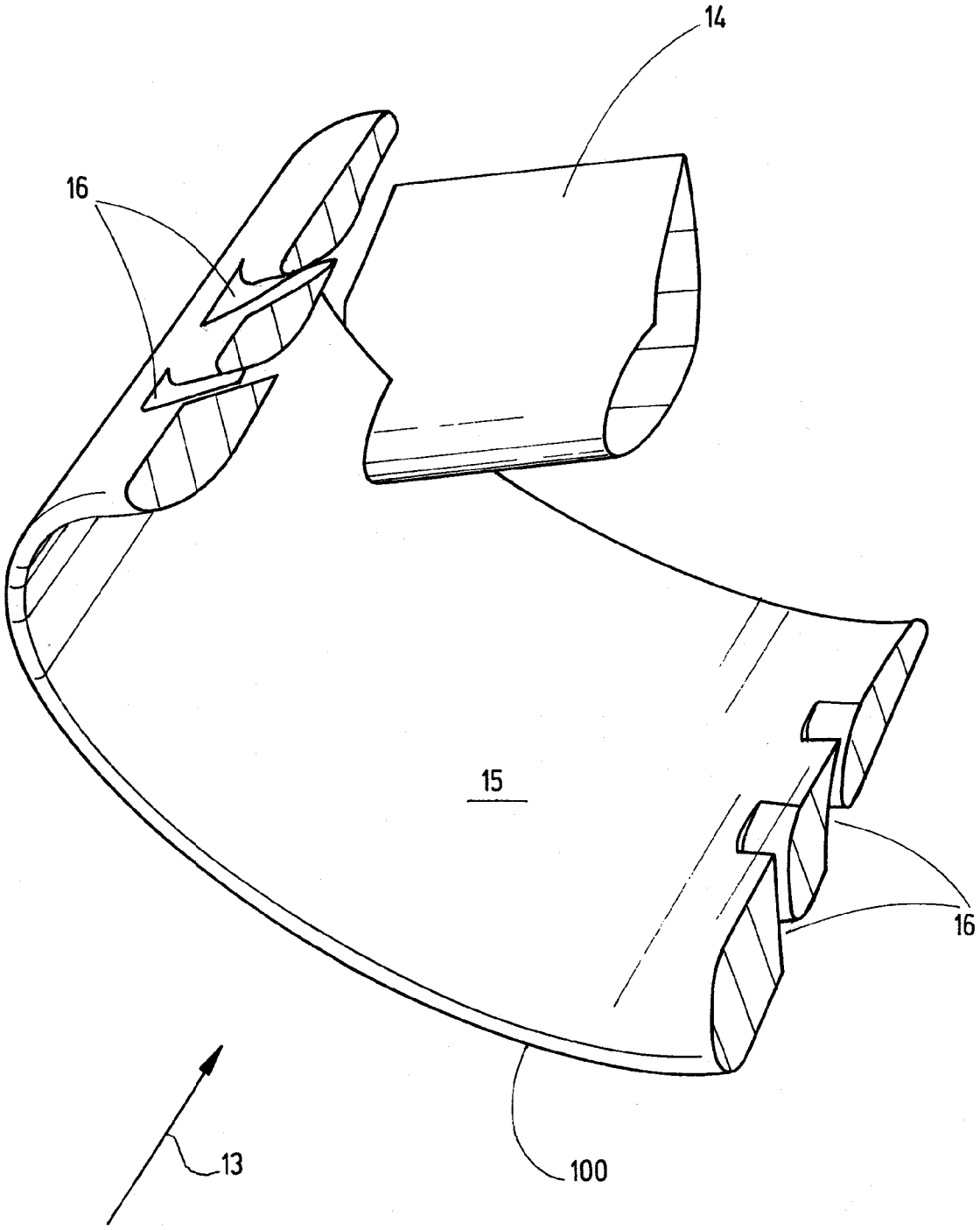
FIG. 2*b* shows schematically a sectional view of the Kort nozzle of FIG. 2*a*.

FIG. 2*b* shows a sectional view of the Kort nozzle 100 of FIG. 2*a*. It can be recognized that the openings 16 are placed respectively opposite each other in both central areas 15*a*, 15*b* of the nozzle ring 15. Moreover, these openings 16 extend obliquely from the outside to the inside in flow direction 13. The single openings 16 of each central area 15*a*, 15*b* are molded respectively identical and thus extend parallel to each other.

Figure 3:
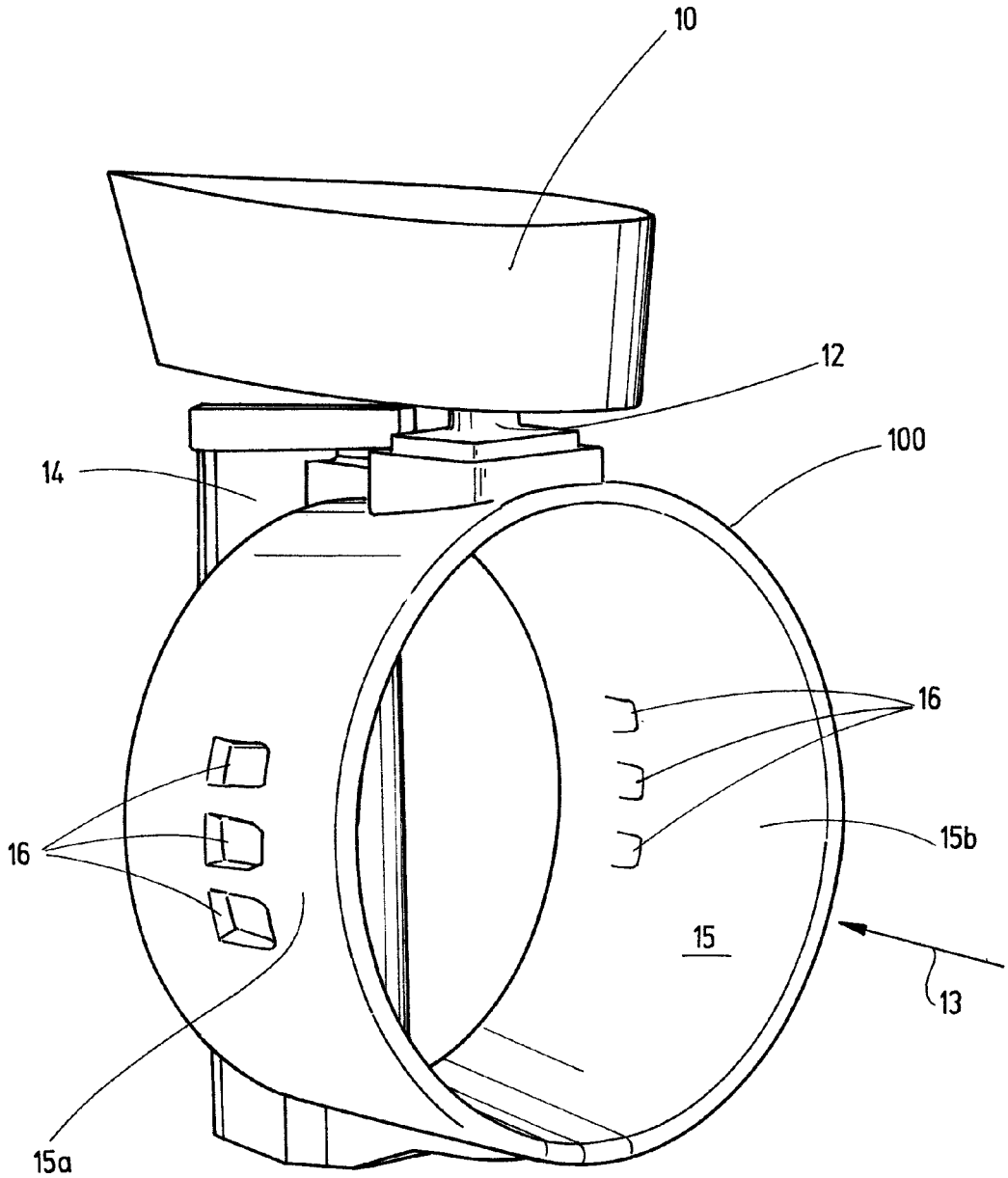
FIG. 3 shows schematically a perspective view of a Kort nozzle swivelably positioned on the hull of a ship with respectively three openings situated in succession in a vertical direction in each central area.

FIG. 3 shows a further embodiment of a Kort nozzle 100 according to the invention. For this embodiment, three openings 16 placed one above the other in a vertical direction are provided in each central area 15*a*, 15*b* of the nozzle ring 15. The openings 16 are placed respectively in the middle with respect to the longitudinal direction of the Kort nozzle 100. The distance between the single openings 16 of the central areas 15*a*, 15*b* is respectively approximately the same. In total there are provided six openings 16 in the nozzle ring, since there are no other openings outside the central areas 15*a*, 15*b*. The openings of each central area are configured symmetrically with respect to each other. As can be seen from FIGS. 1*a* to 3, the openings 16 are entirely disposed within the central areas of the nozzle ring and do not extend beyond the central areas.

Figure 4:
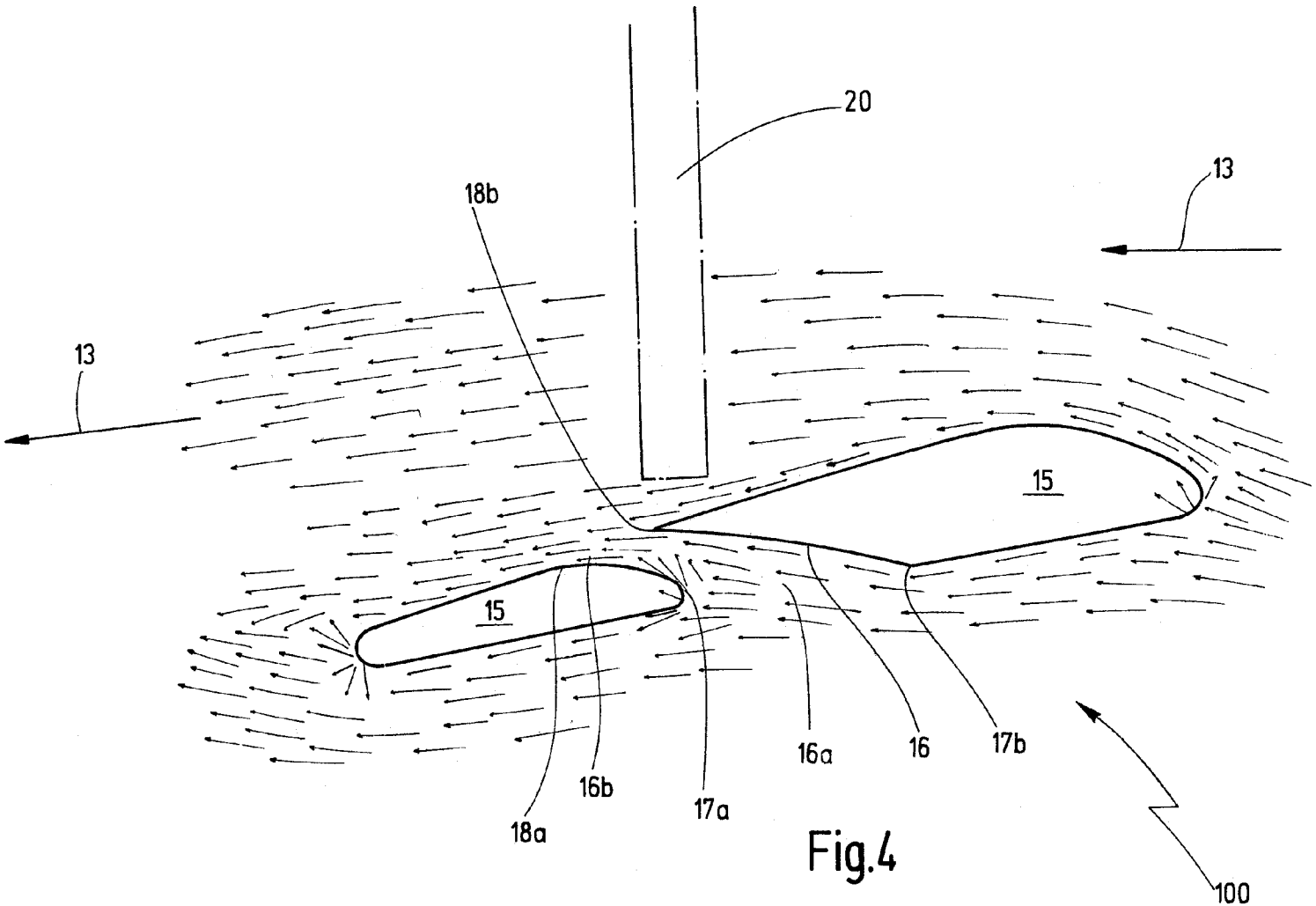
FIG. 4 shows schematically a sectional top view of a portion of a Kort nozzle with an opening, the illustration having flow lines.
Figure 5:
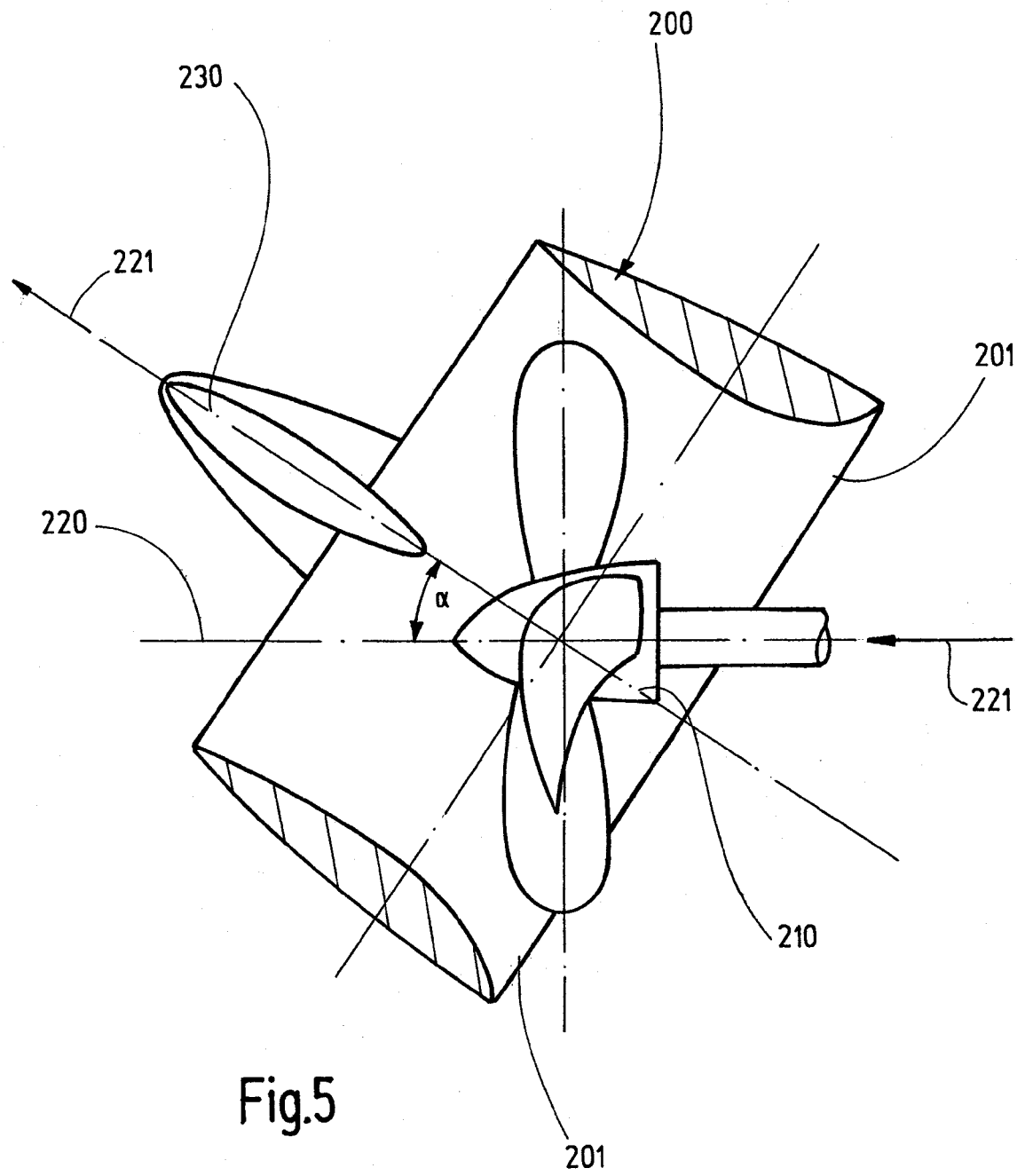
FIG. 5 illustrates an embodiment of a prior art Kort nozzle positioned rotatable about the rudder axis of a ship with a fixed propeller placed therein.
Figure 6A:
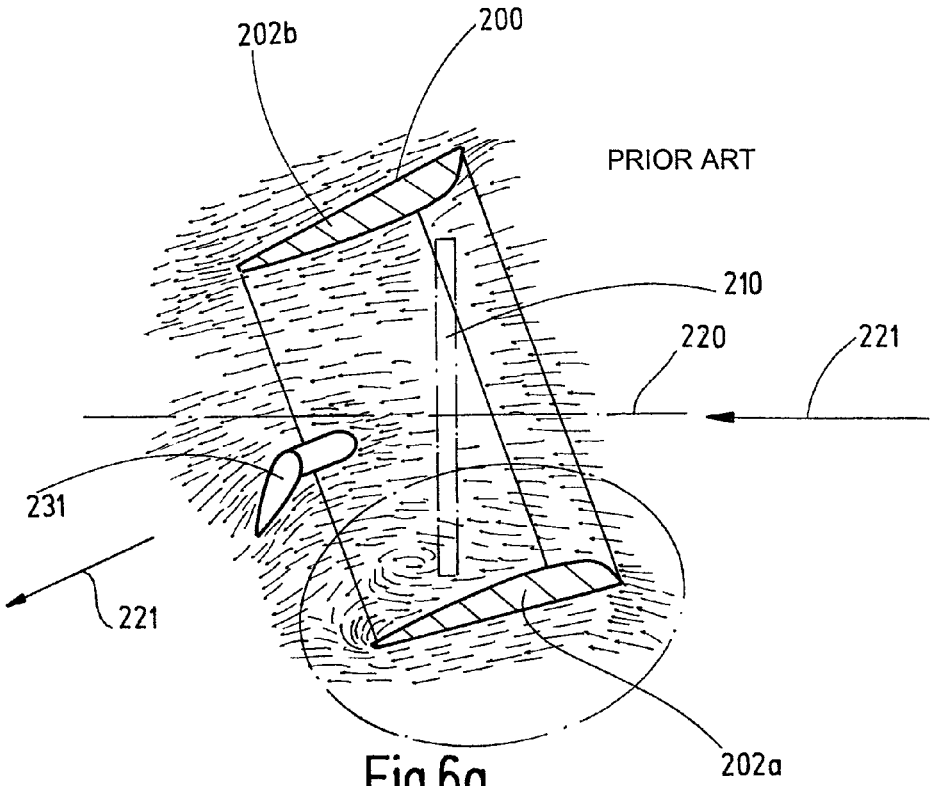
FIG. 6*a* is a schematic illustration of a top view of a cut Kort nozzle known in the prior art.
Figure 6B:
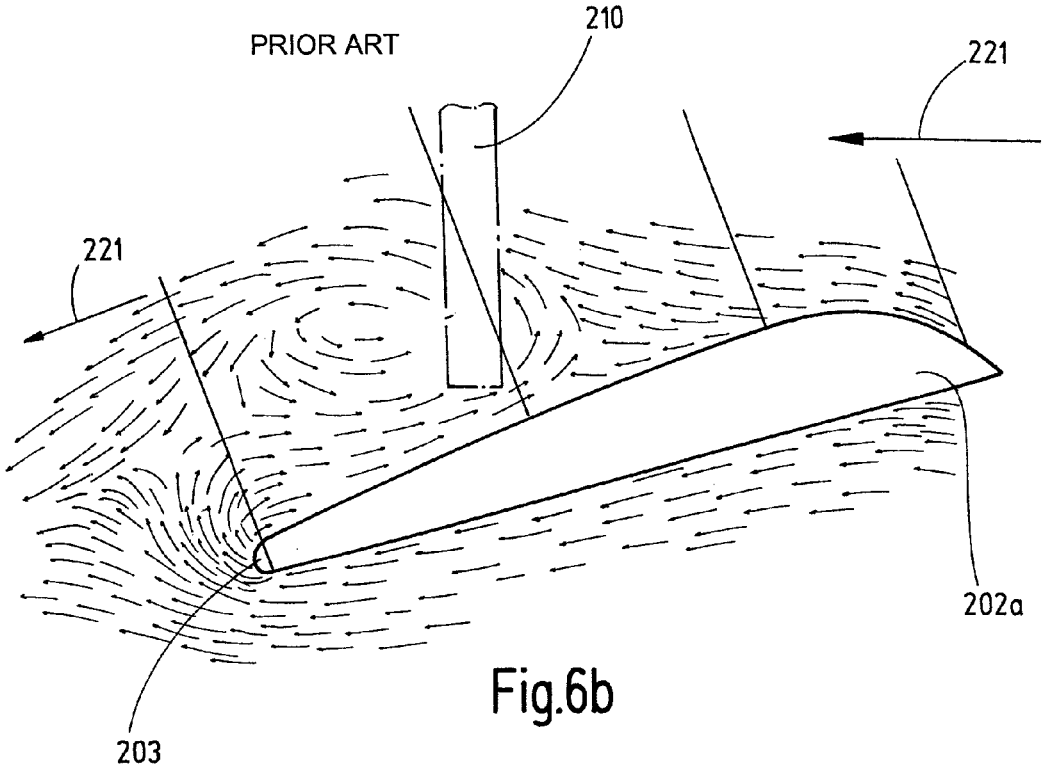
FIG. 6*b* illustrates the lower part of the Kort nozzle shown in FIG. 6*a*.

FIG. 4 shows a flow pattern of a side area of a Kort nozzle 100 with a portion of a schematically depicted propeller 20. Overall, the depiction of FIG. 4 is similar to that of FIG. 6*b*, whereby contrary to the depiction of FIG. 6*b* a Kort nozzle according to the invention with an opening 16 has been used. The represented arrows symbolize the flow course of the water flowing through the Kort nozzle. As it can be recognized, water flows from the outside to the inside through the opening 16. As soon as it passes the inner opening area 16*b* of the opening 16 it flows further along the inner side of the nozzle ring 15 until it finally leaves the Kort nozzle 100. Thus, no recirculation or swirl can form in the area between the outer side of the propeller 20 and the end side of the Kort nozzle 100 with respect to the flow direction 13. On the contrary, the whole flow flows laminarly inside the Kort nozzle 100 and also outside on the edge of the Kort nozzle 100.

The invention claimed is:

1. A Kort nozzle configured to be swivelable about a vertical axis of rotation, wherein the Kort nozzle comprises an integrally formed nozzle ring which envelops a fixed ship propeller, wherein the nozzle ring has two central areas with respect to the height of the Kort nozzle, the first of said central areas being located on the starboard side of the nozzle ring and the second of said central areas being located on the port side of the nozzle ring, wherein in each of said central areas at least one opening in the nozzle ring is provided for creating a flow connection from outside the Kort nozzle to the inside of the Kort nozzle, wherein the at least one opening of the first central area and the at least one opening of the second central area are always unsealed so that water continuously flows through both openings, wherein outside of said central areas the nozzle ring is configured watertight and has no openings.

2. The Kort nozzle according to claim 1, wherein the at least one opening of the first central area and the at least one opening of the second central area are disposed substantially opposite each other.

3. The Kort nozzle according to claim 1, wherein the central areas range from one-third to two-thirds of the height of the Kort nozzle.

4. The Kort nozzle according to claim 1, wherein the central areas range from two-fifths to three-fifths of the height of the Kort nozzle.

5. The Kort nozzle according to claim 1, wherein at least two openings are disposed in each central area of the Kort nozzle, wherein the at least two openings are arranged in a longitudinal direction of the Kort nozzle one behind the other or in a vertical direction above one another.

6. The Kort nozzle according claim 1, wherein the at least one opening of the first central area and the at least one opening of the second central area are disposed with respect to the length of the Kort nozzle in an area from one-third to two-thirds of the length.

7. The Kort nozzle according claim 1, wherein the at least one opening of the first central area and the at least one opening of the second central area are disposed with respect to the direction of propeller flow aft of the propeller in a non-deflected state of the Kort nozzle.

8. The Kort nozzle according claim 1, wherein the nozzle ring is configured conically tapered.

9. The Kort nozzle according to claim 1, wherein the at least one opening of the first central area and the at least one opening of the second central area are disposed with an inner opening area adjacent to the propeller at a swiveling angle of the Kort nozzle of 10° to 20°.

10. The Kort nozzle according to claim 1, wherein the at least one opening of the first central area and the at least one opening of the second central area are configured as oblong slits extending in vertical direction.

11. The Kort nozzle according to claim 1, wherein the at least one opening of the first central area and the at least one opening of the second central area extend obliquely through the nozzle ring from the outside of the nozzle ring to the inside of the nozzle ring with respect to the main flow direction.

12. The Kort nozzle according to claim 11, wherein the at least one opening of the first central area and the at least one opening of the second central area extend with an angle of 10° to 60° with respect to the longitudinal axis of the Kort nozzle.

13. The Kort nozzle according to claim 1, wherein the at least one opening of the first central area and the at least one opening of the second central area are configured tapering from the outer side of the nozzle ring to the inner side of the nozzle ring.

14. The Kort nozzle according to claim 1, wherein the dimensions of the at least one opening of the first central area and the dimensions of the at least one opening of the second central area are substantially constant over their entire extension.

15. The Kort nozzle according to claim 1, wherein the admission edges and/or the discharge edges of the at least one opening of the first central area and the at least one opening of the second central area are configured rounded-off.

16. The Kort nozzle according to claim 1, wherein the at least one opening of the first central area and the at least one opening of the second central area are configured to be symmetrical to each other.

17. The Kort nozzle according to claim 6, wherein the area is from two-fifths to three-fifths of the length.

18. The Kort nozzle of claim 17, wherein the area is in the middle of the length.

19. The Kort nozzle of claim 9, wherein the swiveling angle of the Kort nozzle is twelve degrees to eighteen degrees.

20. The Kort nozzle of claim 19, wherein the swiveling angle of the Kort nozzle is fifteen degrees.

21. The Kort nozzle of claim 12, wherein the angle is twenty degrees to forty-five degrees.

22. The Kort nozzle of claim 21, wherein the angle is thirty degrees to thirty-five degrees.

23. Ship, comprising a Kort nozzle (100) according to claim 1, at its stern.

* * * * *